US005813712A

United States Patent [19]

Mozelt

[11] Patent Number: 5,813,712

[45] Date of Patent: Sep. 29, 1998

[54] MAGNETIC LOAD LIFTING DEVICE

[75] Inventor: Winfried Mozelt, Duisburg, Germany

[73] Assignee: Mozelt GmbH & Co. KG, Duisburg, Germany

[21] Appl. No.: 708,540

[22] Filed: Sep. 5, 1996

[30] Foreign Application Priority Data

Sep. 12, 1995 [DE] Germany ..... 195 33 740.9

[51] Int. Cl.[6] ..... B66C 1/04

[52] U.S. Cl. ..... 294/65.5; 335/291; 361/144

[58] Field of Search ..... 294/65.5; 361/142, 361/144; 335/291, 292, 294

[56] References Cited

U.S. PATENT DOCUMENTS

| | | | |
|---|---|---|---|
| 3,196,320 | 7/1965 | Manting | 361/144 |
| 4,323,329 | 4/1982 | Chlad . | |
| 4,600,964 | 7/1986 | Ela et al. | 361/144 |
| 4,647,268 | 3/1987 | Scholl | 294/65.5 |
| 5,325,260 | 6/1994 | Repetto | 361/144 |

FOREIGN PATENT DOCUMENTS

| | | |
|---|---|---|
| 31 03 607 | 9/1982 | Germany . |
| 2185730 | 7/1987 | United Kingdom . |

OTHER PUBLICATIONS

"Lasthebemagnete im Stahlhandel (I)" by K. Freitag, dhf May 1986, pp. 42–45.

"Lasthebemagneteimim Stahlhandel (II)" by K. Freitag, dhf Jun. 1986, pp. 27–34.

"Ohne Netz" Demag Fördertechnik, Industrie–Anzeiger 1978/81, pp. 17 to 20.

"Magnete" Industrie–Anzeiger 93–Nr. 13 of Feb. 12, 1971 (p. 253).

Mechanical Handling, Jan. 1966 (p. 14).

*Primary Examiner*—Dean Kramer

*Attorney, Agent, or Firm*—Collard & Roe, P.C.

[57] ABSTRACT

A magnetic lifting device having a load lifting magnet with at least one magnetic coil arranged in a housing. A driven synchronous alternator is arranged in a housing for generating a voltage supplied to the magnetic coil. A supply line leading from the alternator to the magnetic coil supplies direct current to the magnetic coil. An electrical switching circuit with a control line arranged within the alternator housing connects to a control switch outside the alternator housing through a further control line outside the alternator housing. The control switch actuates a first rectifier connected to the alternator for powering the coil of the magnet. It also deactivates the magnet by powering a second rectifier of a reverse polarity to release the magnet load. The control switch also includes an overload signal and alarm, and a ready light when the magnet is ready to be powered.

13 Claims, 2 Drawing Sheets

MAGNETIC LOAD LIFTING DEVICE

BACKGROUND OF THE INVENTION

1. Field of the Invention

The present invention relates to a magnetic lifting device comprising a load lifting magnet comprised of at least one magnetic coil arranged in a housing, a driven electrical generator for generating a voltage supplied to the magnetic coil, a supply line leading from the generator to the magnetic coil, an electrical switching means with a control line and a control switch.

2. Description of the Prior Art

In magnetic lifting devices used in industry, for example in overhead cranes, installations are usually provided for supplying direct current to the magnetic coils of the lifting devices. If only alternating current is available, current from this source is supplied through transformers and rectifiers, with suitable control means for supplying direct current to the magnetic coils.

Such an arrangement cannot be used with mobile cranes or mobile dredgers because they move from place to place. In this case, the current supply means must be carried on the lifting devices themselves. For this purpose, it is known to systems comprising an alternator as current generator. The alternating current generated by the alternator is converted by a transformer into the required voltage and this voltage is then conducted by rectifiers and protective devices to the magnetic coils of the lifting device. The accommodation of these means has encountered considerable difficulties because of their size. In general, these installations are not economical.

In addition to the above-described installations, two other systems are presently in use. One uses a free-running direct current generator and the other uses a separately excited direct current generator for supplying the direct current to the magnetic coils.

Free-running generators are driven by a motor, for example an internal combustion engine, a hydraulic motor or an electric motor. The generator generates a direct current of 230 V. This current is conducted to a switching circuit and is also used to operate the desired indicators, commands and switching procedures, such as "magnet IN" and "magnet OUT", upon actuation of respective control switches. The switching circuit in the 230 V circuit comprises various resistances as well as switching protectors whose contacts are provided with spark or arcing protection. These generators do not have dependable operational characteristics with respect to short circuits in the connecting cable to the magnetic coil. They tend to be deactivated because of the high short circuit current and must then be reactivated by an outside voltage to reactivate them.

As the capacity of the lifting magnets increases, the switching circuits must be adapted to the increased capacity. With load lifting magnets having a diameter of about 1300 mm (4.26 feet) and a power of about 8.5 kW, the switching circuits assume such a size and weight that it is difficult to accommodate them on mobile dredgers.

These generators usually are of the protection IP 23 type (IP=International Protection norm, indicating the degree of protection against penetration of humidity and dust into electrical machines), while the other structural elements are of protection IP 20 type. Such machines are completely open to penetration by humidity and dust. Therefore, operational disturbances and interruptions often occur because foreign substances penetrate the installations. Furthermore, they require considerable maintenance and are relatively inefficient because the protective devices must also be supplied with power. An additional disadvantage is the dangerously high voltage of 230 V on a mobile crane or dredger.

If a separately excited direct current generator is used as source of current supply to the magnet, it is driven by a external motor. A supply line connects the generator to the magnet to supply a 230 V current thereto. In addition, a switching circuit with a control voltage of 12 or 24 V direct current is provided, this d.c. current being taken from the current network of the crane or dredger. This d.c. current serves simultaneously as control voltage and exciting voltage for the associated control of the generator. Since the excitation coil of the generator requires only small nominal currents, the generator control can use commercially available relays typically used in the electronic of circuits of trucks. With such a generator, no protective switching circuit is needed because the control can be performed with a d.c. current of 12 or 24 V.

Both above-described current supply installations have the disadvantage that they require a large and expensive control unit in the control system. Moreover, the wiring of the control is often complex. In many types of mobile dredgers, there is hardly any room in the driver's cab or below the sheet metal body of the upper carrying chassis to accommodate the switching circuit. Another disadvantage of direct current generators is that their power output must be conducted through an exposed commutator. This is undesirable when it is used on a construction machine. The usual protection type IP 23 generators are sensitive to penetration of abrasive and grinding dust. This causes the carbon brushes of the commutator to be quickly worn out, thereby reducing the operating life of the generator. While closed machines beginning with protection type IP 45 (protected against water poured over them) will prevent penetration of dust into the interior of the generator, temperature changes will cause condensation precipitation in the machine in the form of films of humidity. Once condensated, the humidity will not fully evaporate when the machine is warmed up again. Thus, the formation of an oxide or rust layer is possible, and the oxidation or rusting is enhanced by the ozone produced in the machine. This aggressive ozone gas is released as soon as even minor brush sparking occurs at the collector. This may happen, for example, when a short circuit occurs in the 230 V main circuit. The progressive formation of rust, with the resultant destruction of the machine, therefore, cannot be prevented.

SUMMARY OF THE INVENTION

It is the primary object of this invention to provide a magnetic lifting device of the first described type, which can be fixed without requiring an expert when an operational disturbance or interruption occurs.

It is a further object of the invention to provide a magnetic lifting device which is simple in design, easy to use and reliable in operation.

This and other objects are accomplished according to the invention with a magnetic lifting device having a load lifting magnet comprised of at least one magnetic coil arranged in a housing, a driven synchronous alternator arranged in a housing for generating a voltage supplied to the magnetic coil, a supply line leading from the alternator to the magnetic coil for supplying direct voltage to the magnetic coil, an electrical switching circuit with a control line arranged within the alternator housing, a control switch disposed outside the alternator housing, and a further control line disposed outside the alternator housing for connecting the control switch to the control line of the electrical switching circuit.

Such a magnetic lifting device can be readily serviced by non-skilled labor. Since no special control is used, no expert is required to find and fix the fault in the system when a disturbance occurs. Moreover, the entire defective generator may simply be removed and replaced by a new generator to fix the breakdown. The defective generator may then be repaired in a workshop which is equipped with the necessary repair tools. Such a repair does not involve a lengthy down-time for the lifting device but merely the short down-time required to replace the defective generator with a working generator. This leads to a longer operating life of the magnetic lifting device and to a saving in skilled personnel.

Preferably, the switching circuit with the control line operates without contacts and is driven in a stand-by mode. A motor of a type differing from that of the alternator may be used for driving the alternator, for example an internal combustion motor, a hydraulic motor, or an electric motor. The supply line advantageously supplies 230 d.c. volt to the magnetic coil. Furthermore, it is desirable to operate the further control line outside the alternator housing with a voltage of 12 or 24 V. If the magnetic lifting device is arranged on a mobile crane or dredger, and the like, the alternator may be driven by a motor, for instance a hydraulic motor of the mobile machine on which it is mounted.

Preferably, the synchronous alternator is of protective type IP 55 (protected against penetration of water sprayed onto the machine under high pressure), with two main windings and an integrated exciter machine with a shunt winding.

BRIEF DESCRIPTION OF THE DRAWING

The above and other objects, advantages and features of the invention will be described hereinbelow in connection with a now preferred embodiment thereof, taken in conjunction with the accompanying schematic drawing, wherein.

DETAILED DESCRIPTION OF THE PREFERRED EMBODIMENT

Figure 1:
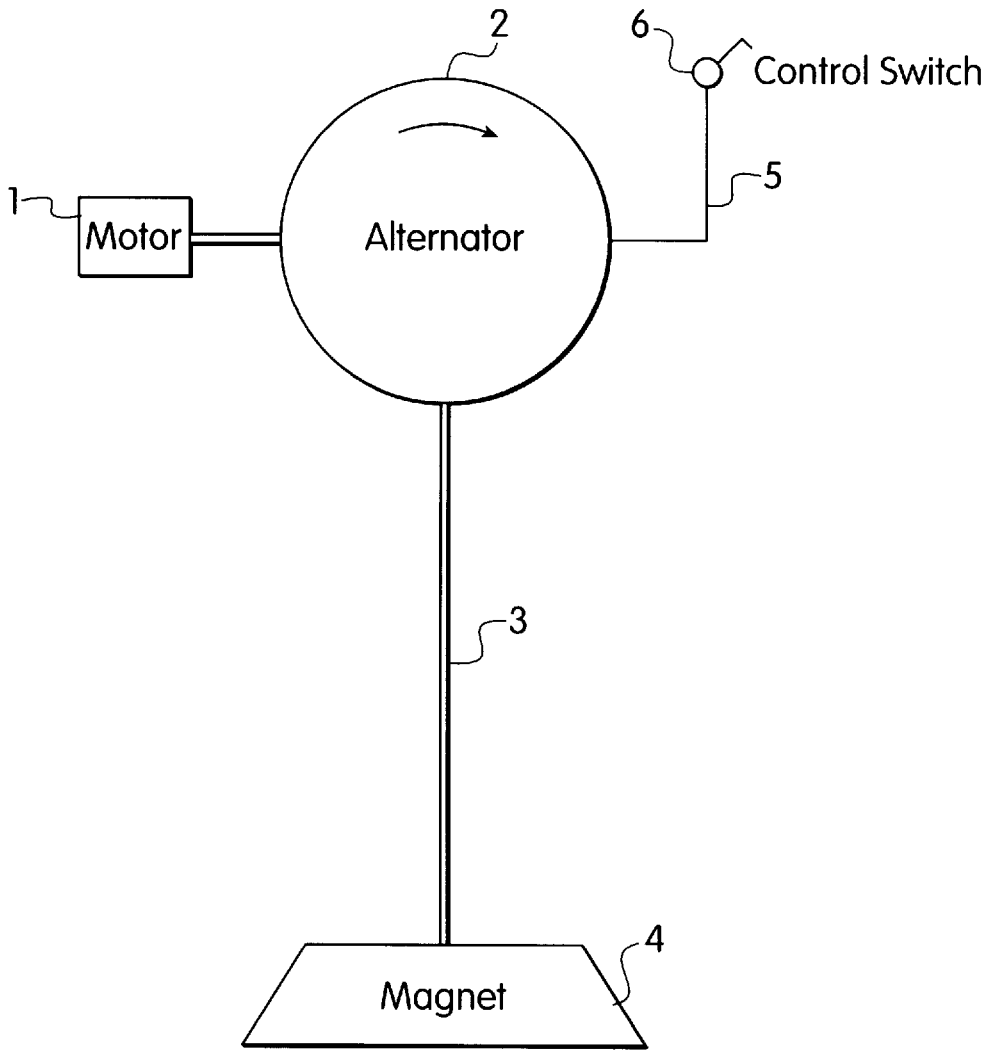
FIG. 1 shows a simplified diagram of the device.
Figure 2:
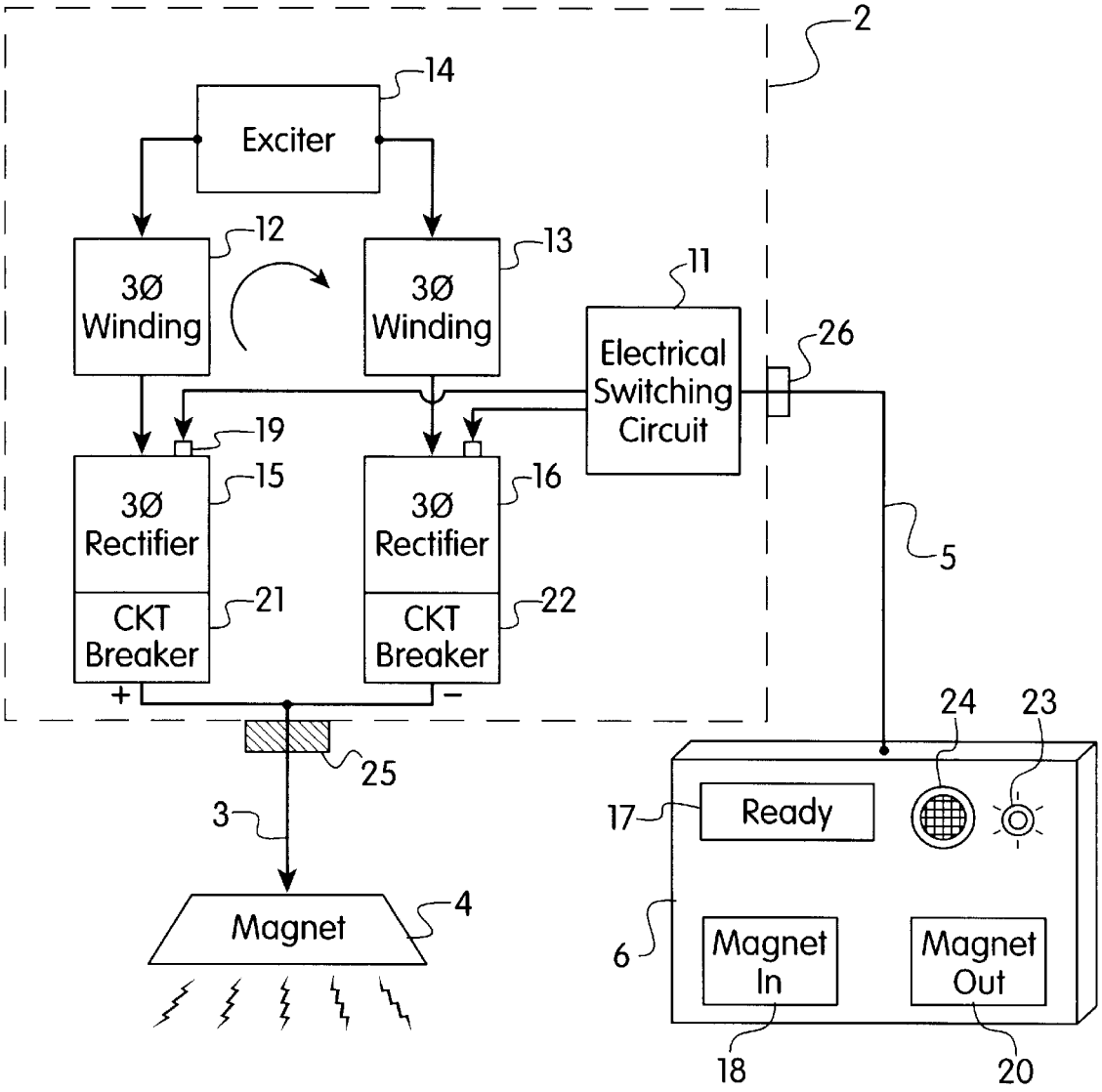
FIG. 2 is a circuit diagram.

Referring to FIGS. 1 and 2, the magnetic lifting device comprises load lifting magnet 4 comprised of at least one magnetic coil arranged in a housing. A synchronous alternator 2 is shown, driven by motor 1 and arranged in a housing for generating a voltage supplied to the magnetic coil. Supply line 3 leads from alternator 2 to the magnetic coil and supplies direct current to the magnetic coil. An electrical switching circuit is provided with a control line arranged within the alternator housing. Control switch 6 is located outside the alternator housing and is connected to a further control line 5, outside the alternator housing. The further control line connects control switch 6 to the control line of the electrical switching circuit. The switching circuit 11 is integrated within the alternator and is a conventional circuit.

The electrical current supply system used in the magnetic lifting device of the present invention preferably comprises a synchronous alternator of protective type IP 55, with two main windings 12 and 13, and an integrated exciter machine 14 with a shunt winding. Its main circuit comprises two three-phase controllable thyristor rectifier bridges 15 and 16 in a non-parallel connection. The nominal value of the output voltage is a pulsating d.c. voltage of 230 V. When synchronous alternator 2 is driven by motor 1, its two main windings 12 and 13 generate a predetermined three-phase voltage which is conducted to the two rectifier bridges 15 and 16. The rectifier bridges are held initially inactive and generate no output voltage. The shunt winding generates the internal control voltage as an integrated exciter machine. The operating readiness of the generator and the control are signaled by an illuminated indicator 17 at control switch 6 which signals "Ready."

When the command "Magnet IN" 18 is initiated by control switch 6, thyristor gates 19 of rectifier bridge 15 are actuated and switch the power and d.c. voltage of 230 V directly to magnet coil 4 connected to alternator 2. The energized magnetic coil 4 then causes the ion material to be attracted to the magnet, lifted, and held by the magnet.

If the command "Magnet OUT" 20 is initiated by the control switch 6, this interrupts the actuation of gates 19 of rectifier bridge 15, and the flow of current to magnet 4 is stopped. A free-running diode in the magnet circuit at the output of the 230 V voltage will then, within a time period of 0.5 to 1.0 seconds, reduce the induction voltage of the magnet coil until the current in the circuit is reduced to zero. At this stage, the second rectifier bridge 16 is automatically actuated for a short time period of about 0.3 seconds. Now, the lower d.c. voltage generated by the second main winding of alternator 2 is supplied through the second rectifier bridge to magnet coil 4, but in the opposite polarity. This causes magnet 4 to be deenergized so that the previously held ferrous material is released from magnet 4.

Alternator 2 and its integrated fully electronic circuit require no maintenance. Furthermore, its shunt winding of exciter 14 assures that the alternator is not in a readiness mode, and cannot be switched on if its speed of rotation is more than 15%, and less than 10%, of its nominal speed of rotation.

An effective short circuit protection of the two rectifier bridges may be assured by built-in three-pole, high-speed automatic circuit breakers or safety devices 21 and 22.

When the alternator is overloaded and an operating disturbance occurs, it can be optically or audibly signaled at control switch 6 by light 23 or buzzer 24.

Supply line 3 leading from alternator housing 2 to magnet 4 is connected by clamping bolts in a connecting box 25 on the housing of the alternator while control line 5 leading to control switch 6 is plugged in by a four-pole plug 26. No external control device is required if such alternators are used as current source for magnetic load lifting devices. Thus, the incorporation of such a current source for the lifting magnet of a mobile dredger, for example, requires only the mechanical incorporation of the alternator, the connection of the d.c. current supply line 3 to alternator 2, laying out supply line 3 over the outrigger to the load lifting magnet, and plugging in control line 5, and leading the control line to control switch 6 located in the operator's cab.

The result is a maintenance-free, dependable and reliable operating system which may be readily handled by the operator. The manufacturer has no problems with the installation, service, operating instructions to the operating personnel or later guarantee claims. The system is technically simple and easily understandable by everyone. Lists of replacement parts are reducibly to a minimum because the system requires few such parts.

While only a single embodiment has been described, various modifications will readily occur to those of ordinary skill in the art without departing from the scope of the invention, as defined in the appended claims.

What is claimed is:

1. A magnetic lifting device comprising (a) a load lifting magnet having at least one magnetic coil arranged in a housing, (b) a driven synchronous alternator arranged in a housing for generating a current supplied to the magnetic coil, (1) the alternator comprising a first and second three-phase winding, (c) a supply line coupling the alternator to the magnetic coil for supplying direct current to the magnetic coil, (d) an electrical switching circuit with a control line arranged within the alternator housing, (e) a control switch disposed outside the alternator housing, and (f) a further control line disposed outside the alternator housing, said further control line connecting said control switch to said control line of the electrical switching circuit.

2. The magnetic lifting device of claim 1, wherein the electrical switching circuit with its control line operates contactless and is driven in a stand-by mode.

3. The magnetic lifting device of claim 1 additionally comprising a motor of a type differing from that of the alternator for driving the alternator.

4. The magnetic lifting device of claim 3, wherein the motor is an internal combustion engine.

5. The magnetic lifting device of claim 3, wherein the motor is a hydraulic motor.

6. The magnetic lifting device of claim 3, wherein the motor is an electric motor.

7. The magnetic lifting device of claim 1, wherein the supply line supplies 230 d.c. volt to the magnetic coil.

8. The magnetic lifting device of claim 1, wherein said further control line disposed outside the alternator housing is operated with a voltage of 12 or 24 V.

9. The magnetic lifting device of claim 1, wherein said alternator includes first and second three-phase rectifiers respectively coupled to the input of said first and second three-phase windings, and having an output coupled to the magnetic coil.

10. The magnetic lifting device of claim 9, wherein each of said rectifiers includes a control gate and is coupled to the electrical switching circuit.

11. The magnetic lifting device of claim 10, wherein each of said rectifiers produces a voltage of opposite polarity, and said switching circuit operates one or the other rectifier to turn on or off the voltage supplied to the magnetic coil.

12. The magnetic lifting device of claim 11 comprising a power supply cable for coupling the magnetic coil to said alternator, said cable including clamping bolts for quickly connecting and disconnecting said cable to the alternator housing.

13. The magnetic lifting device of claim 12, wherein said control switch includes a ready indicator, means for turrning on and off the power to the magnetic coil, and audible alarm and overload indicator lamp.

* * * * *